US006299418B1

(12) United States Patent
Honaga et al.

(10) Patent No.: US 6,299,418 B1
(45) **Date of Patent: *Oct. 9, 2001**

(54) OIL PUMP APPARATUS

(75) Inventors: Susumu Honaga; Hidetoshi Fujiwara, both of Aichi-ken; Motoyasu Yamamori, Nagoya, all of (JP)

(73) Assignee: Toyoda Koki Kabushiki Kaisha, Kariya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/148,510

(22) Filed: Sep. 4, 1998

(30) Foreign Application Priority Data

Sep. 5, 1997 (JP) ..... 9-257528

(51) Int. Cl.[7] ..... F04B 23/00; F16D 31/02
(52) U.S. Cl. ..... 417/440; 91/446
(58) Field of Search ..... 417/310, 440, 417/251, 137; 91/446, 451, 452; 137/538; 251/205

(56) References Cited

U.S. PATENT DOCUMENTS 4,917,139 4/1990 Narumi et al. .
5,822,988 * 10/1998 Kato ..... 60/468

* cited by examiner

*Primary Examiner*—Andrew M. Dolinar
*Assistant Examiner*—Arnold Castro
(74) *Attorney, Agent, or Firm*—Oblon, Spivak, McClelland, Maier & Neustadt, P.C.

(57) ABSTRACT

An oil pump apparatus, including a pump mechanism portion for discharging operating fluid, a valve-receiving bore formed in a housing, a flow control valve arranged in the valve-receiving bore connected to a bypass hole, and a bypass passage. The bypass passage is connected to the bypass hole, having a space radially extending from an edge of the bypass hole in a fluid stream direction of the excess operating fluid spouting from an opening area of the bypass hole. When fluid stream of the excess operating fluid reaches the inner surface of the bypass passage, the pressure of the excess operating fluid has been weaken sufficiently because fluid stream of the excess operating fluid is diffused by the long span of the bypass passage extended from the edged of the bypass hole. Therefore, the inner surface of the bypass passage is protected from cavitation damages and erosion.

20 Claims, 5 Drawing Sheets

OIL PUMP APPARATUS

BACKGROUND OF THE INVENTION

1. Field of the Invention

The present invention relates to an oil pump apparatus for supplying operating fluid to a power-assisting portion of a power steering apparatus of vehicles and the like. More particularly, the present invention relates to improvements of a bypass passage located between an inlet side of the pump mechanism portion and a flow control valve.

2. Description of the Prior Art

Oil pump apparatuses have been proposed for a power steering apparatus of vehicles and the like. In general, the conventional oil pump apparatus mainly consists of a pump mechanism portion and a flow control valve. The pump mechanism portion supplies operating fluid (i.e., oil) to a power-assisting portion of the power steering apparatus. The flow control valve maintains a flow rate of the operating fluid supplied to the power-assisting portion constant by draining part of the operating fluid to an inlet side of the pump mechanism portion as excess operating fluid.

An example of the oil pump apparatus is shown in a Japanese Utility Model No. 05-19594. As shown in FIG. 1, this oil pump apparatus includes a bypass hole 30 and a bypass passage 20 connecting with each other. The bypass hole 30 connects with the flow control valve 31 and the bypass passage 20 connects with the inlet side of the pump mechanism portion. The excess operating fluid is drained through the bypass hole 30 and the bypass passage 20.

The oil pump apparatus also includes an opening 150 of a reservoir passage connecting to a reservoir. The opening 150 is located in the connecting portion between the bypass hole 30 and the bypass passage 20.

In the conventional oil pump apparatus, a cross-sectional area of the bypass passage 20 widens in a side of the opening 150 of a reservoir passage, i.e., the center axis of the bypass passage 20 is placed offset from the center axis of the bypass hole 30 (shown by an eccentric distance d). In the configuration, since strong fluid stream (shown by arrows A) of the excess operating fluid is drained with causing negative pressure, the operating fluid is effectively led from the reservoir to the inlet side of the pump mechanism portion. As a result, enhanced is suction efficiency of the operating fluid supplied from the opening 150 of a reservoir passage, i.e., supercharging effect. Therefore, a width of the bypass passage 20 is designed to be as wide as possible in the side of the opening 150 in order to include almost of all area of the opening 150.

After gathering in the bypass passage 20, the excess operating fluid drained from the flow control valve 31 and the operating fluid sucked by the jet, i.e., strong stream A, of the excess operating fluid are led to an inlet port of the pump mechanism portion.

As described above, when the excess operating fluid is drained from the bypass hole 30 to the bypass passage 20, the stream of the excess operating fluid spouts with high pressure as the jet A. The jet A dashes against an inner surface of the bypass passage 20 near the bypass hole 30, so as to possibly cause cavitation damages, i.e., erosion. In addition, since the cavitation removes tiny broken pieces from the inner surface of the bypass passage 20, the tiny broken pieces enter in the pump mechanism portion, so as to deteriorate quality of the pump mechanism portion.

SUMMARY OF THE INVENTION

Accordingly, it is an object of the present invention to provide an improved oil pump apparatus capable of decreasing cavitation damages and erosion of its bypass passage and bypass hole.

Another object of the present invention is to provide an improved oil pump apparatus whose stream of excess operating fluid reaches an inner surface of the bypass passage after the pressure of the stream is weakened.

Briefly, these and other objects of this invention as hereinafter will become more readily apparent as having been attained broadly by an oil pump apparatus, including a pump mechanism portion for discharging operating fluid, a valve receiving bore formed in a housing, a flow control valve arranged in the valve receiving bore, and a bypass passage.

The valve receiving bore is connected to a supply passage for leading the operating fluid discharged from the pump mechanism portion and connected to a bypass hole for draining excess operating fluid to a reservoir. The flow control valve has a bypass spool for regulating an opening area of the bypass hole in order to control a flow rate of the operating fluid by draining excess operating fluid. The bypass passage is connected to the bypass hole, having a space radially extending from an edge of the bypass hole in a fluid stream direction of the excess operating fluid spouting from the opening area of the bypass hole.

In the oil pump apparatus, when the pump mechanism portion is driven, the operating fluid is supplied to the flow control valve in the valve receiving bore through the supply passage. The flow control valve maintains the flow rate of the operating fluid a determined rate by draining the excess operating fluid through the opening of the bypass hole defined by the bypass spool.

When the excess operating fluid is drained from the bypass hole to the bypass passage, the excess operating fluid spouts from the opening area of the bypass hole, contacting with the inner surface of the bypass passage. When fluid stream of the excess operating fluid reaches the inner surface of the bypass passage, the pressure of the excess operating fluid has been weaken sufficiently. The reason is that fluid stream of the excess operating fluid is diffused by the long span of the bypass passage extended from the edged of the bypass hole. Since the total area receiving the fluid stream of the excess operating fluid is widen by the diffusion of the excess operating fluid, decreased is pressure acting on a unit area of the inner surface of the bypass passage. Therefore, the energy of the fluid stream of the excess operating fluid is decreased by the widen cross-sectional area of the bypass passage. As a result, the inner surface of the bypass passage is protected from cavitation damages and erosion, so as that the quality of the oil pump apparatus is enhanced.

The effect of the protection for the bypass passage especially effective in the case of that the housing is made of materials which is comparatively easily eroded such as aluminum and aluminum alloy.

In preferable construction, the space of the bypass passage further radially extends in a direction toward an opening of a reservoir passage connecting to a reservoir, so as that the bypass passage includes almost of all area of the opening of the reservoir passage.

In this case, the oil pump apparatus is capable of decreasing suction resistance when the operating fluid is inhaled from the reservoir to the pump mechanism portion through the opening of the reservoir passage, since widen is a space in vicinity of the opening of the reservoir passage for discharging the operating fluid. Therefore, the operating fluid is smoothly supplied to the pump mechanism portion even when the operating fluid becomes to have high viscosity such as under low-temperature condition.

In another preferable construction, a width of the bypass passage in a direction perpendicular to the fluid stream direction of the excess operating fluid is approximately the same as a diameter of the bypass hole.

In this case, though a cross-sectional area of the bypass passage is increased, size of the housing of the oil pump apparatus is maintained small.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENT

[First Embodiment]

A first embodiment of the present invention is described with reference to the accompanying drawings.

Figure 1:
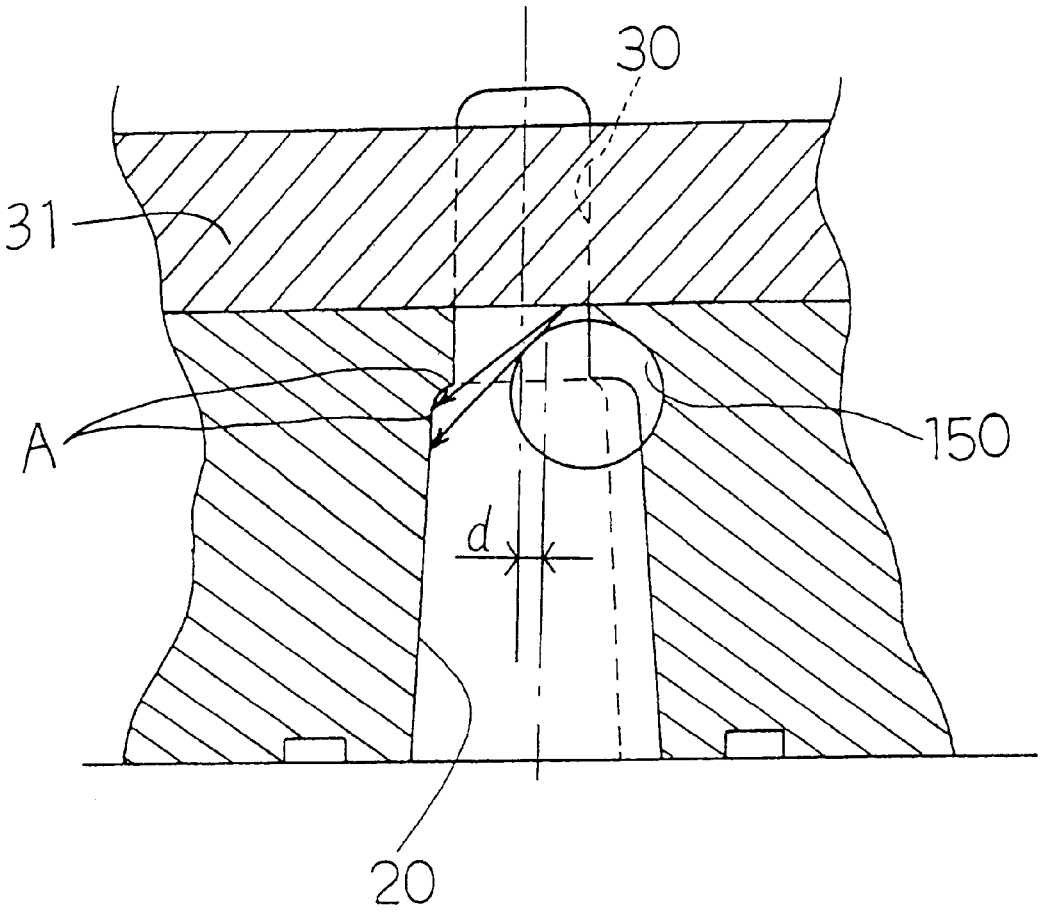
FIG. 1 (PRIOR ART)
FIG. 1 is a sectional view illustrating a bypass hole and a bypass passage of a conventional oil pump apparatus.
Figure 2:
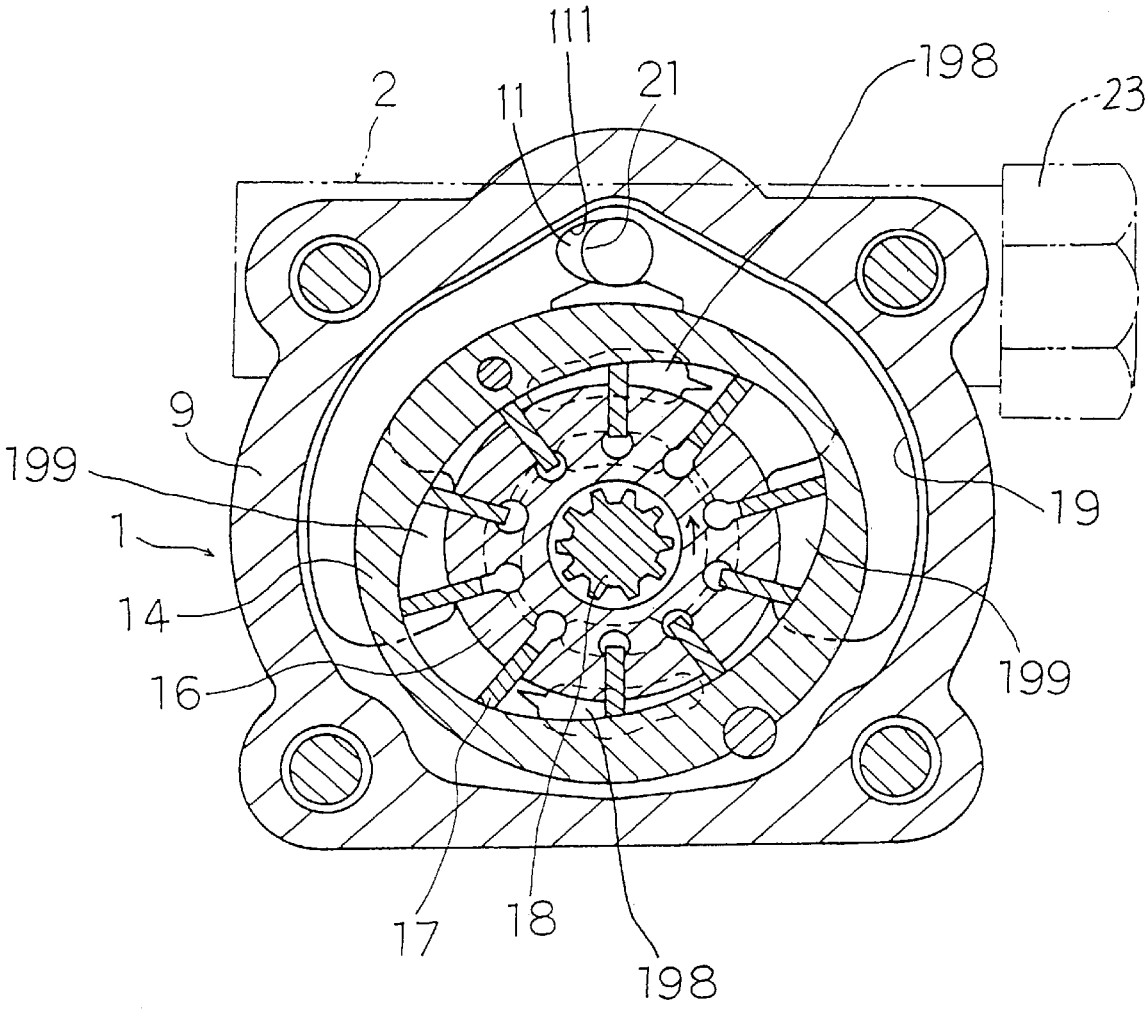
FIG. 2 is a sectional view illustrating a pump mechanism portion of an oil pump apparatus of a first embodiment in accordance with the present invention.

As shown in FIG. 2, an oil pump apparatus of the embodiment is mainly composed of a pump mechanism portion 1 and a flow control valve 2. The oil pump apparatus is for supplying operating fluid to a power assist portion (not shown) in order to assist steering wheel operation. The power assist portion includes a control valve, a power cylinder and the like as well known in a conventional power steering apparatus of a vehicle. The flow control valve is for maintaining a flow rate of the operating fluid supplied to the power cylinder a determined rate by draining part of the operating fluid to an inlet cavity 19 (i.e., an inlet side) of the pump mechanism portion 1 as excess operating fluid.

A vane type pump apparatus represents the pump mechanism portion 1 as an example, which includes a drive shaft 18, a rotor 16, vanes 17, a cam ring 14 and a main housing 9 accommodating these pump parts. The drive shaft 18 is rotatably mounted within the main housing 9, which is driven by an automotive engine or a motor. The rotor 16 is supported on the drive shaft 18 through a spline engagement for its rotation. Each of vanes 17 is slidably fitted in each of slits of the rotor 16, which is circumferentially equally spaced from each other, so as to move radially outwardly from the rotor 16. The cam ring 14 has a pair of cam surfaces symmetrically arranged with respect to the center axis of the drive shaft 18 in its inner surface. The cam surfaces form a plurality of pump chambers with the vanes 17.

Figure 3:
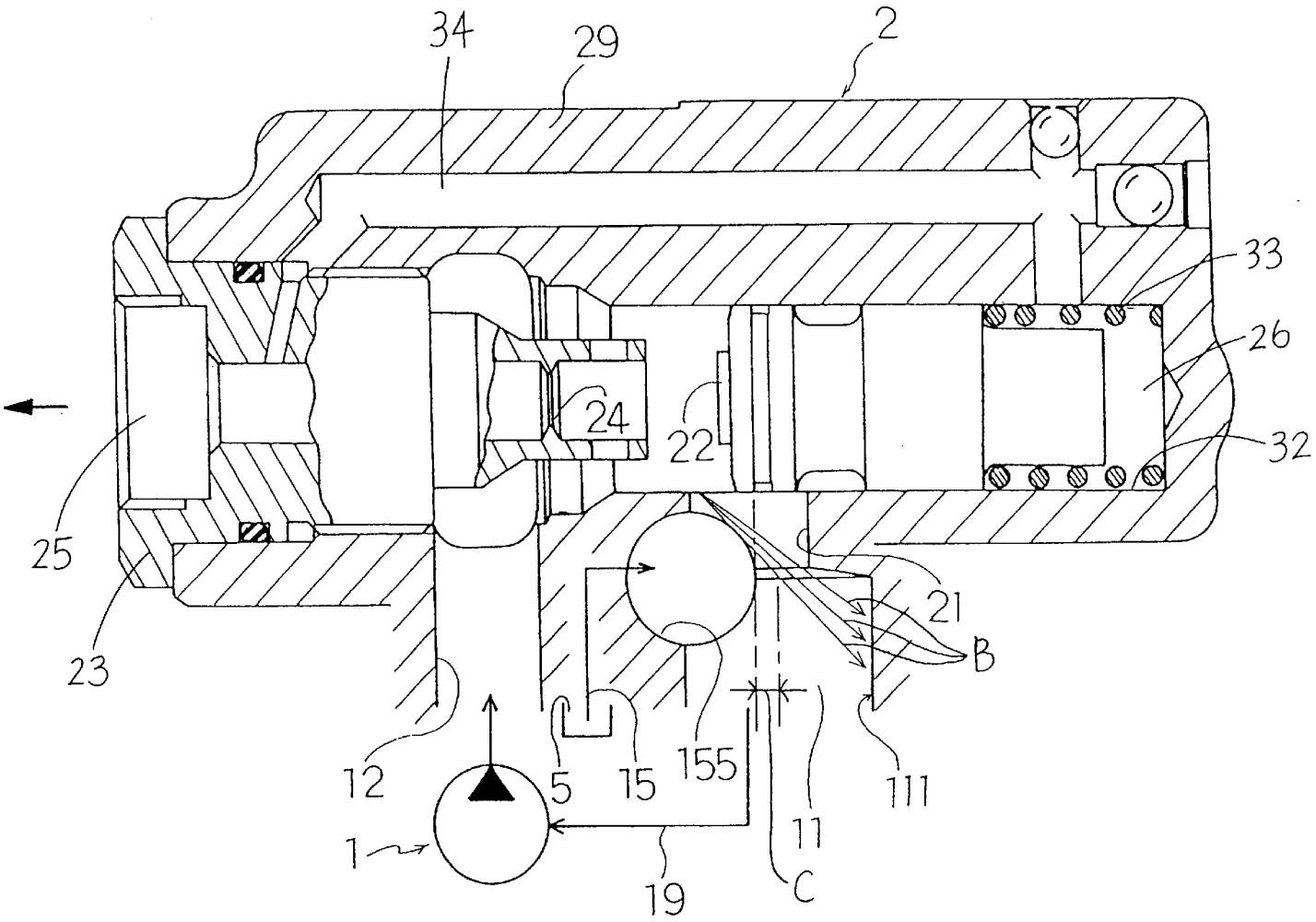
FIG. 3 is a sectional view illustrating a flow control valve of the oil pump apparatus of the first embodiment.

The flow control valve 2 is shown in FIG. 3, which has a valve housing 29 mounted on the main housing 9. A valve receiving bore 32 is formed in the valve housing 29. A union 23 is screwed into an opening of the valve-receiving bore 32. A supply passage 12 and a bypass hole 21 are connected to the valve-receiving bore 32, respectively. The supply passage 12 and the bypass hole 21 are spaced in axial direction of the valve-receiving bore 32, each of which has a circular cross-sectional shape. The supply passage 12 is connected to a discharged port 198 of the pump mechanism portion 1. The bypass hole 21 is connected to a bypass passage 11. The bypass passage 11 is connected to a suction port 199 of the pump mechanism portion 1 through the inlet cavity 19.

An opening 155 of a reservoir passage 15 connecting to a reservoir 5 is located in the connecting portion between the bypass hole 21 and the bypass passage 11.

The union 23 has a cylindrical shape with a union bore coaxially corresponding to the valve-receiving bore 32. In each end of the union 23, an outlet port 25 and a metering orifice 24 are formed, respectively. The outlet port 25 is connected to the power cylinder through the control valve of the power assist portion. The metering orifice 24 is arranged to communicate with the supply passage 12.

A bypass spool 22, arranged next to the union 23, is slidably received in the valve-receiving bore 32 to control the flow rate of the operating fluid supplied to the control valve. A spring chamber 26 is formed between one end of the bypass spool 22 and the end portion of the valve-receiving bore 32. The spring chamber 26 contains a spring 33 urging the bypass spool 22 toward the union 23 to narrow an opening area of the bypass hole 21, so that communication between the supply passage 12 and the bypass hole 21 is regulated.

The spring chamber 26 is connected to the outlet port 25 through a connection passage 34 formed in the valve housing 29 and the union 23.

In the above construction, differential pressure across the metering orifice 24 acts the bypass spool 22, i.e., the pressure before the metering orifice 24 acts on the left end of the bypass spool 22 and simultaneously the pressure passed through the metering orifice 24 acts on the right end of the bypass spool 22. Therefore, the bypass spool 22 adjusts the opening area of the bypass hole 21 to maintain the differential pressure across the metering orifice 24 constant. In the operation of the flow control valve 2, part of the operating fluid, i.e., the excess operating fluid, is drained from the bypass hole 21 and is led to the inlet cavity 19 through the bypass passage 11.

As shown in FIGS. 2 and 3, the bypass passage 11 radially widens in a direction of the fluid stream of the excess operating fluid (i.e., jet B shown by arrows) draining from the bypass hole 21, having an oval cross-sectional shape. In detail, the center axis of the bypass passage 11 is placed offset from that of the bypass hole 21 with an eccentric distance C in the opposite side of the opening 155 of the reservoir passage 15, so as that a long span of the bypass passage 11 is longer than a diameter of the bypass hole 21.

In the configuration, when the excess operating fluid is drained from the bypass hole 21 to the bypass passage 11, the jet B of the excess operating fluid obliquely spouts from an opening area of the bypass hole 21 defined by the bypass spool 22. However, the long span of the bypass passage 11 is designed to be sufficiently long in order to decrease pressure of the jet B before the jet B reach an inner surface 111 of the bypass passage 11.

In the other hand, as shown in FIG. 2, a short span of the bypass passage 11 is designed to correspond to the diameter of the bypass hole 21 in order to decrease cross-sectional area of the bypass passage 11. Therefore, sizes of the main housing 9 and the valve housing 29 are maintained small.

The operation of the oil pump apparatus constructed above is described hereinafter. When the pump mechanism portion 1 is driven by the automotive engine or the motor, the operating fluid is supplied from the discharged port 198 of the pump mechanism portion 1 to the supply passage 12.

The operating fluid discharged to the supply passage 12 passes through the metering orifice 24 and the outlet port 25 to the control valve of the power assist portion. At the same time, the operating fluid, which has passed through the metering orifice 24, is introduced into the spring chamber 26 through the connection passage 34.

Therefore, since the differential pressure across the metering orifice 24 acts on the bypass spool 22, the opening of the bypass hole 21 is adjusted to maintain the differential pressure constant, keeping the flow rate of the operating fluid supplied to the control valve a determined rate.

The excess operating fluid passed through the bypass hole 21 is drained to the reservoir 15 through the bypass hole 21, the bypass passage 11 and the reservoir passage 15, and also is led to the inlet cavity 19 of the pump mechanism portion 1.

When the excess operating fluid is drained from the bypass hole 21 to the bypass passage 11, the excess operating fluid obliquely spouts from the opening area of the bypass hole 21 as the jet B, reaching the inner surface 111 of the bypass passage 11. While the jet B passes through the long span of the bypass passage 11, the pressure of the jet B is sufficiently weaken because the jet B is diffused in the long span of the bypass passage 11 designed for spacing the inner surface 111 from the edge of the bypass hole 21. In the inner surface 111 of the bypass passage 11, since the total area receiving the jet B of the excess operating fluid is widen by the diffusion of the excess operating fluid, pressure acting on a unit area of the inner surface 111 is decreased. Therefore, the energy of the fluid stream of the excess operating fluid is decreased by the widen cross-sectional area of the bypass passage 11. As a result, the inner surface 111 of the bypass passage 11 is protected from cavitation damages and erosion, so as that the quality of the oil pump apparatus is enhanced with no increase of the size thereof.

The effect of the protection for the bypass passage 11 is especially effective in the case of that the main housing 9 and the valve housing 29 is made of materials which is comparatively easily eroded such as aluminum and aluminum alloy.

In the embodiment, though the bypass passage 11 is formed in the oval cross-sectional shape to space the inner surface 111, the bypass passage 11 is also formed in an elliptical or a rectangular cross-sectional shape for modifications.

[Second Embodiment]

Figure 4:
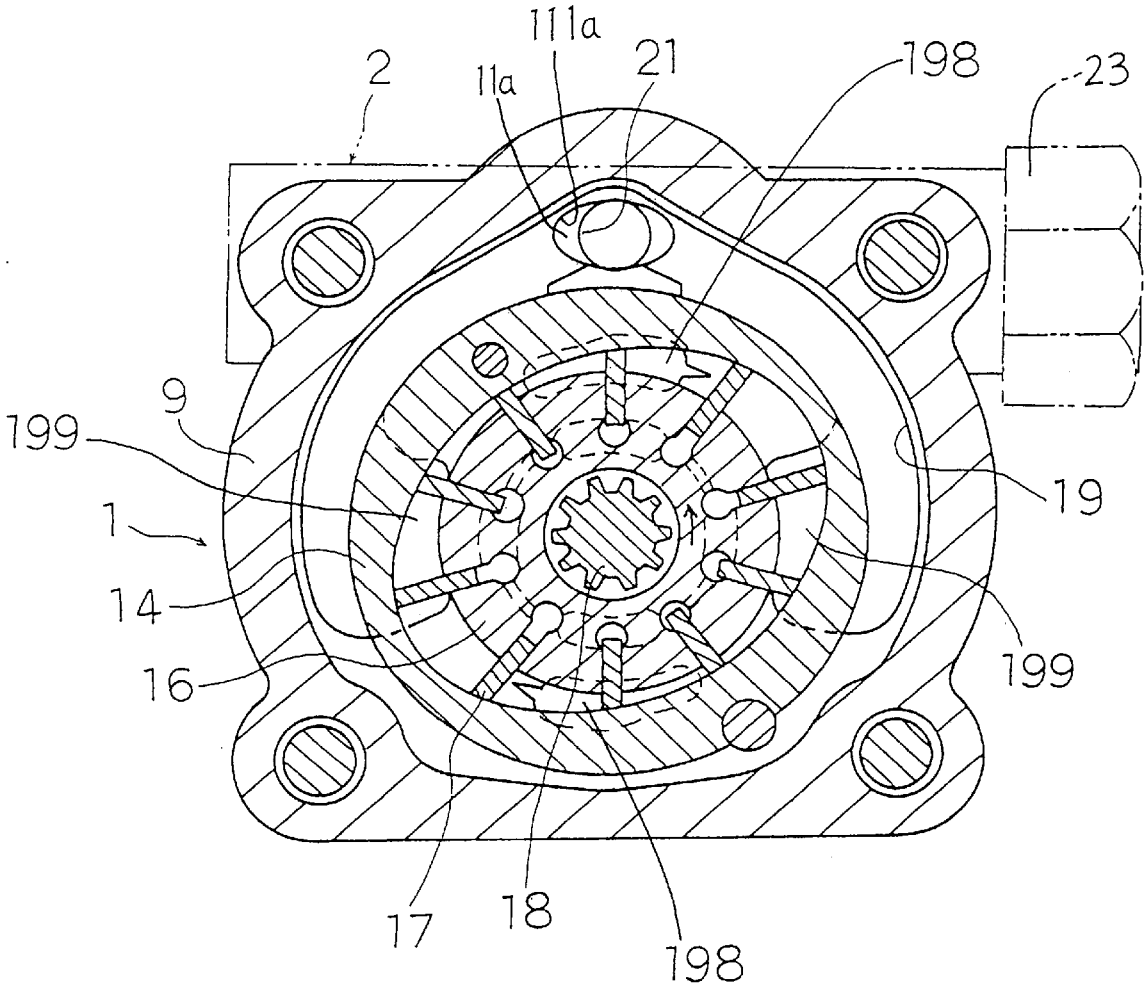
FIG. 4 is a sectional view illustrating a pump mechanism portion of an oil pump apparatus of a second embodiment in accordance with the present invention.
Figure 5:
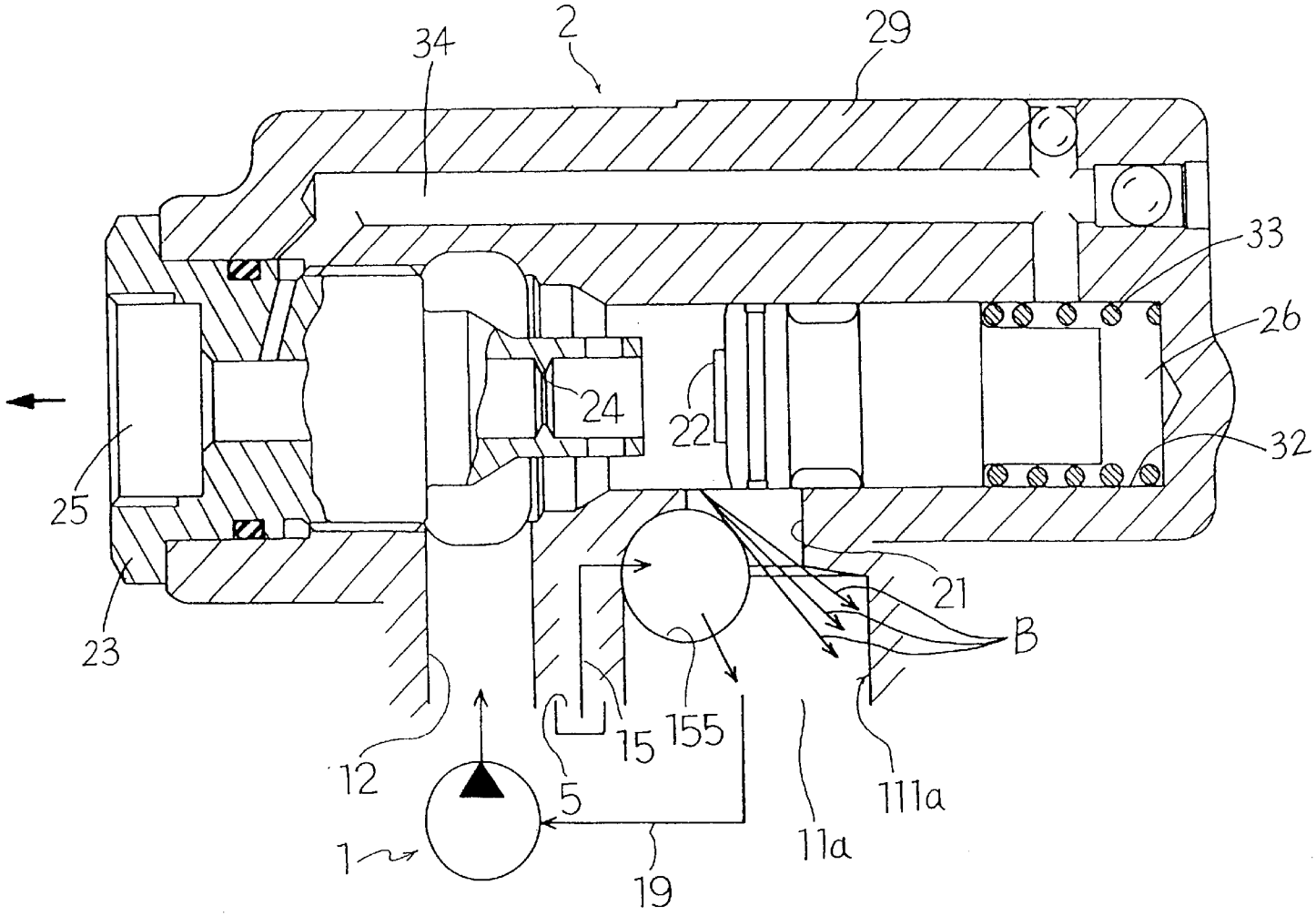
FIG. 5 is a sectional view illustrating a flow control valve of the oil pump apparatus of the second embodiment.

FIGS. 4 and 5 show another preferred embodiment of an oil pump apparatus. The oil pump apparatus has a significant difference from the first embodiment previously described. FIGS. 4 and 5 are respectively comparable to FIGS. 2 and 3 for the first embodiment. Several parts of the second embodiment, substantially the same as those of the first embodiment, are identified by the same reference character of the first embodiment. Therefore, the description of these parts in the second embodiment is omitted. The other parts of the second embodiment, different from those of the first embodiment, are identified by the same reference character.

The difference of the second embodiment is that a bypass passage 11*a* radially widens not only in the direction of jet B spouting from the bypass hole 21, but also radially widens in the direction to the opening 155 of the reservoir passage 15, having an elliptical, that is, non-circular cross-sectional shape.

In detail, the bypass passage 11*a* coaxially connects with a bypass hole 21 with no eccentric distance of the center axis. A long span of the bypass passage 11*a* is designed to be longer than a diameter of the bypass hole 21 in order to sufficiently decrease pressure of the jet B of the excess operating fluid before the jet B reach an inner surface 111*a* of the bypass passage 11*a*.

In the other hand, as shown in FIG. 4, a short span of the bypass passage 11*a* is designed to correspond to the diameter of the bypass hole 21 in order to maintain sizes of the main housing 9 and the valve housing 29 small.

In addition, as shown in FIG. 5, the bypass passage 11*a* is designed to completely include the opening 155 of the reservoir passage 15 in order to increase an open space in vicinity of the opening 155. The widen opening space decreases suction resistance when the operating fluid is inhaled from the reservoir 15 to the pump mechanism portion 1 through the opening 155 of the reservoir passage 15. Therefore, the operating fluid is smoothly supplied to the inlet side of the pump mechanism portion 1 even when the operating fluid becomes to have high viscosity such as under low-temperature condition.

As a result, the oil pump apparatus of the second embodiment not only has the same effect of the first embodiment, but also has the additional effect capable of smoothly supplying the operating fluid from the reservoir 5 to the pump mechanism portion 1.

In the second embodiment, though the bypass passage 11*a* is formed in the elliptical cross-sectional shape, the bypass passage 11*a* is also formed in an oval or a rectangular cross-sectional shape for modifications.

What is claimed is:

1. An oil pump apparatus comprising:

a pump mechanism portion for discharging operating fluid;

a valve receiving bore, formed in said housing, connected to a supply passage for leading the operating fluid discharged from said pump mechanism portion and connected to a bypass hole for draining excess operating fluid to a reservoir;

a flow control valve, arranged in said valve receiving bore, having a bypass spool for regulating an opening area of said bypass hole in order to control a flow rate of the operating fluid by draining the excess operating fluid; and a bypass passage connected to said bypass hole, having a space radially extending from an edge of said bypass hole in a fluid stream direction of the excess operating fluid spouting from the opening area of said bypass hole, said radial extension being such that said bypass passage is non-circular as viewed in an axial direction of said bypass passage.

2. The oil pump apparatus according to claim 1, wherein the center axis of said bypass passage is offset from the center axis of said bypass hole.

3. The oil pump apparatus according to claim 1, further comprising a reservoir passage connected to said reservoir and said bypass passage.

4. The oil pump apparatus according to claim 3, wherein the size of said bypass passage is radially expanded in a direction opposite to an opening of said reservoir passage.

5. The oil pump apparatus according to claim 4, wherein the size of said bypass passage is further radially expanded in a direction toward the opening of said reservoir passage.

6. The oil pump apparatus according to claim 5, wherein the size of said bypass passage is further radially expanded in a direction toward the opening of said reservoir passage, so as that said bypass passage includes almost all of an area of the opening of said reservoir passage.

7. The oil pump apparatus according to claim 6, wherein a length of said bypass passage from the center axis of said bypass passage to the opening of said reservoir passage is approximately the same as that of said bypass passage from the center axis of said bypass passage to an inner surface of said bypass passage in the fluid stream direction.

8. The oil pump apparatus according to claim 6, wherein a cross sectional shape of said bypass passage is an elliptical shape.

9. The oil pump apparatus according to claim 1, a width of said bypass passage in a direction perpendicular to the fluid stream direction of the excess operating fluid is approximately the same as a diameter of said bypass hole.

10. The oil pump apparatus according to claim 1, wherein the housing is made of aluminum.

11. An oil pump apparatus comprising:

a pump mechanism portion for discharging operating fluid;

a valve-receiving bore, formed in a housing, connected to a supply passage for leading the operating fluid discharged from said pump mechanism portion and connected to a bypass hole for draining excess operating fluid to a reservoir;

a flow control valve, arranged in said valve-receiving bore, having a bypass spool for regulating an opening area of said bypass hole in order to control a flow rate of the operating fluid by draining the excess operating fluid; and a non-circular when viewed in an axial direction bypass passage connected to said bypass hole, having a width longer than a diameter of said bypass hole in a fluid stream direction of the excess operating fluid spouting from the opening area of said bypass hole.

12. The oil pump apparatus according to claim 11, wherein the center axis of said bypass passage is biased from the center axis of said bypass hole.

13. The oil pump apparatus according to claim 11, further comprising a reservoir passage connected to said reservoir and said bypass passage.

14. The oil pump apparatus according to claim 13, wherein the width of said bypass passage is radially expanded in a direction opposite to an opening of said reservoir passage.

15. The oil pump apparatus according to claim 14, wherein the width of said bypass passage is further radially expanded in a direction toward the opening of said reservoir passage, so as that said bypass passage includes almost of all area of the opening of said reservoir passage.

16. The oil pump apparatus according to claim 15, wherein a length of said bypass passage from the center axis of said bypass passage to the opening of said reservoir passage is approximately the same as that of said bypass passage from the center axis of said bypass passage to an inner surface of said bypass passage in the fluid stream direction.

17. The oil pump apparatus according to claim 15, wherein a cross sectional shape of said bypass passage is an elliptical shape.

18. The oil pump apparatus according to claim 11, wherein a width of said bypass passage in a direction perpendicular to the fluid stream direction of the excess operating fluid is approximately the same as the diameter of said bypass hole.

19. The oil pump apparatus according to claim 11, wherein the housing is made of aluminum.

20. An oil pump apparatus comprising:

a pump mechanism portion for supplying operating fluid;

a flow control valve for supplying a predetermined amount of operating fluid to a power assisting apparatus by returning part of the operating fluid to an inlet side of said pump mechanism portion as excess operating fluid;

a bypass hole arranged in said flow control valve for draining the excess operating fluid from said flow control valve;

a non-circular when viewed in an axial direction bypass passage connected to said bypass hole and the inlet side for leading the excess operating fluid, a length of a cross-sectional shape of said bypass passage radially extending from an edge of said bypass hole at least in a fluid stream direction of the excess operating fluid in order to increase a contacting area of an inner surface of said bypass passage receiving the excess operating fluid draining from said bypass hole; and a reservoir passage, one end of which is connected in the vicinity of a connecting portion between said bypass hole and said bypass passage, the other end of which is connected to a reservoir.

* * * * *

UNITED STATES PATENT AND TRADEMARK OFFICE

CERTIFICATE OF CORRECTION

PATENT NO. : 6,299,418 B1
DATED : October 9, 2001
INVENTOR(S) : Susumu Honaga et al.

It is certified that error appears in the above-identified patent and that said Letters Patent is hereby corrected as shown below:

Title page,

References Cited, please add the following references:

| | | |
|---|---|---|
| -- 195 13 079 | 10/10/96 | GERMANY |
| 41 35 221 | 04/29/93 | GERMANY |
| 42 37 483 | 05/11/94 | GERMANY |
| 5-19594 | 05/24/93 | JAPAN (with English Abstract) |
| 3-32186 | 03/28/91 | JAPAN (with English Abstract) -- |

Signed and Sealed this

Ninth Day of April, 2002

*Attest:*

*Attesting Officer*

JAMES E. ROGAN
*Director of the United States Patent and Trademark Office*